United States Patent [19]

Patrick

[11] 4,005,630

[45] Feb. 1, 1977

[54] APPARATUS FOR SEPARATING A BULLET FROM A CARTRIDGE CASE

[75] Inventor: Dale M. Patrick, Wyandotte, Mich.

[73] Assignee: Nathan A. Adler, Southfield, Mich. ; a part interest

[22] Filed: Feb. 25, 1975

[21] Appl. No.: 552,741

[52] U.S. Cl. ..... 86/1 A; 279/51

[51] Int. Cl.[2] ..... F42B 33/06

[58] Field of Search ..... 86/1, 1 A; 81/3.05, 81/3.42, 3.41; 279/43, 50, 51

[56] References Cited

UNITED STATES PATENTS

| | | | |
|---|---|---|---|
| 2,349,248 | 5/1944 | Costello | 86/1 A |
| 2,453,642 | 11/1948 | Roy | 279/50 |
| 2,970,508 | 2/1961 | Wicks | 279/51 X |
| 3,056,191 | 10/1962 | Felmet | 81/3.42 X |
| 3,602,084 | 8/1971 | Corcoran | 86/23 |

OTHER PUBLICATIONS

Boehmer, abs. of S.N. 767,895, 669 O.G. 919–920, Apr. 1953.

*Primary Examiner*—Edward A. Miller
*Attorney, Agent, or Firm*—Hauke & Patalidis

[57] ABSTRACT

An apparatus for separating a bullet from a cartridge case, or bullet puller or extractor, comprising a frame, a cartridge hold-down fixture mounted on the frame, and a reciprocating chuck made of a pair of sleeves concentrically and slidably disposed one within the other and operated by a lever means. The inner sleeve has a contractible slitted end forming jaw surfaces engageable over the bullet, and the lever means reciprocating the chuck are arranged to first cause the chuck to grip the bullet by applying a holding force to the jaw surfaces at the end of the inner sleeve by reciprocating the inner sleeve relative to the outer sleeve and engaging the inner sleeve tapered end with a tapered inner surface at the end of the outer sleeve. Subsequent motion of the lever means causes the chuck to be pulled away from the cartridge hold-down, thus separating the bullet from the cartridge case.

8 Claims, 5 Drawing Figures

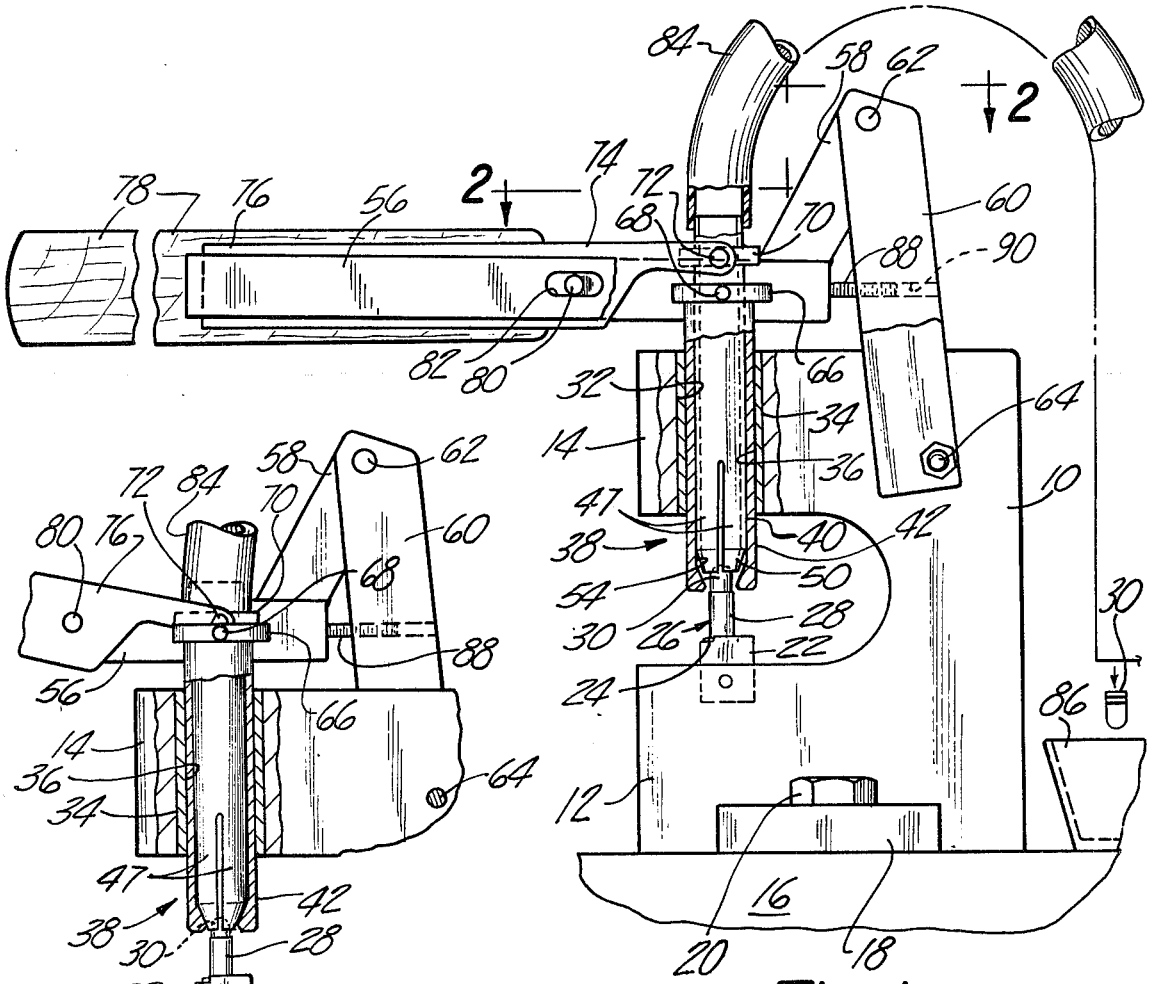
Fig-1
Fig-3
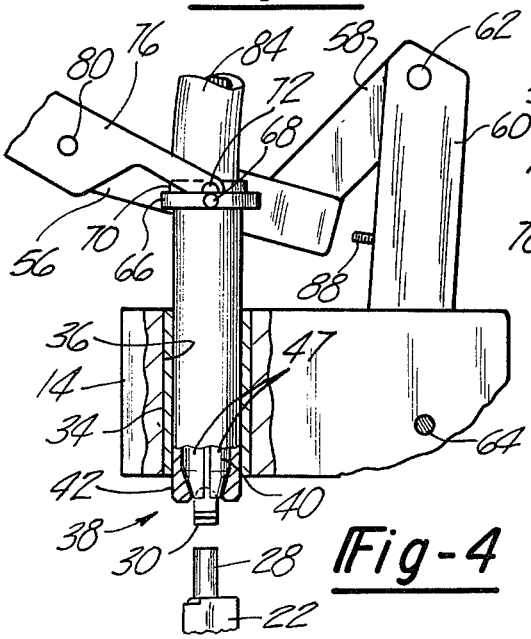
Fig-4
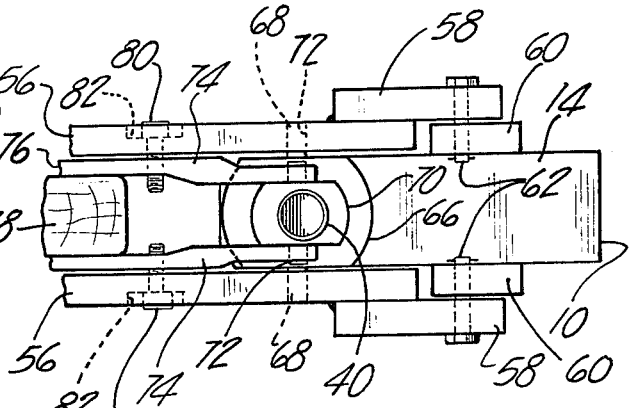
Fig-2

APPARATUS FOR SEPARATING A BULLET FROM A CARTRIDGE CASE

BACKGROUND OF THE INVENTION

The present invention relates in general to bullet pullers or apparatus for separating a bullet from a cartridge case, and more particularly for withdrawing bullets from the mouth of cartridge cases such that cartridges may be separated into their component parts.

In the manufacture of small arms ammunition, it is the practice of manufacturers to pull bullets from cartridge cases, either to reclaim ammunition failing to meet specifications, or for the purpose of production spot inspection or random quality control.

Various devices have been used to remove bullets from cartridge cases, but such devices have met with limited success in that the bullets were marred, scratched, or deeply scarred by the engaging jaws of the bullet puller machine, or such devices have been incapable of pulling blunt bullets, or any other type of bullet having only a short portion projecting from the cartridge casing. Furthermore, some of those devices or machines, as the one disclosed in U. S. Pat. No. 2,369,255, are complex machines with many complicated elements such as hydraulically actuated chucks for gripping the bullet, and they are consequently expensive to manufacture and somewhat delicate in operation, without solving the problem of extracting from cartridge cases bullets having only a short straight portion projecting from the cartridge case mouth.

SUMMARY OF THE INVENTION

Many disadvantages and inconveniences of the prior art bullet pullers, or apparatus for separating a bullet from a cartridge cases, are overcome by the present invention providing a simple apparatus having a bullet gripping chuck capable of exerting considerable force by simple means, without marring the surface of the bullets, which permit to separate from cartidge cases even bullets having short portions projecting from the cases. The apparatus of the invention effectuates the bullet separating motion of the chuck by means of power amplifying lever means which through a single continuous motion first closes the chuck over the bullet for firmly gripping the bullet and subsequently pulls the chuck away from the cartridge hold-down fixture such as to separate the bullet from the cartridge case. Furthermore, the present invention permits to frictionally hold the removed bullet within the chuck such that when the apparatus is used for separating subsequent bullets from their cartridge cases, each bullet causes the preceeding bullets held in the chuck to be automatically fed through the chuck to a conduit for discharging into a container.

BRIEF DESCRIPTION OF THE DRAWING

The objects and advantages of the present invention will become apparent to those skilled in the art when the following description of the best mode contemplated for practicing the invention is read in conjunction with the accompanying drawing wherein:

FIG. 1 is a side elevation view of an apparatus for separating bullets from cartridge cases, according to the present invention, with some portions removed and some portions shown in section;

FIG. 2 is a top plan view thereof from line 2-2 of FIG. 1;

FIG. 3 is a partial view thereof illustrating more particularly the relative position of the bullet gripping or chuck portion thereof at the beginning of a bullet pulling operation;

FIG. 4 is a view similar to FIG. 3, but showing the relative position of the elements of the chuck portion thereof toward the end of a bullet pulling operation.

DETAILED DESCRIPTION OF THE PREFERRED EMBODIMENT

Figure 5:
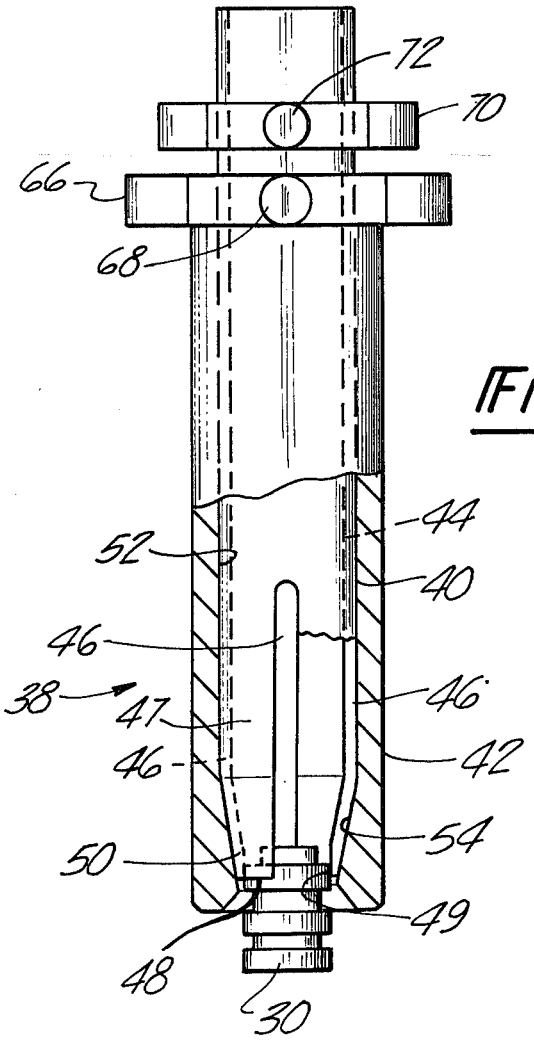
FIG. 5 is a partial sectional view of the chuck thereof, at an enlarged scale.

Referring now to the drawing and more particularly to FIGS. 1 and 2 thereof, an apparatus for separating a bullet from a cartridge case, according to the present invention, comprises a rigid open throat frame 10 defining a lower or base portion 12 and an upper frame portion 14. The frame 10 is preferably made of a sturdy and rigid steel casting, or the like, and is normally bolted on a work bench 16 by any appropriate means such as being provided on both sides with integral mounting lugs 18 having appropriate mounting holes through which is passed a mounting bolt 20, or by any other appropriate convenient mounting means.

A cartridge case hold-down fixture 22 is fastened on the top of the frame base portion 12, the hold-down fixture having a flat surface for supporting the end of a cartridge 26, a semi-circular flange 24 engaging the extraction groove of the cartridge case head 28. In this fashion, the cartridge 26 is firmly held in position in the hold-down fixture 22, enabling considerable force to be exerted on the bullet 30 fitted in the mouth of the cartridge case 28 to extract it therefrom. The upper portion of the frame 14 has a bore 32 provided with an appropriate bushing 34 press-fitted, or otherwise fastened, therein, the cylindrical bore 36 of the bushing 34 being substantially alinged with the hold-down fixture 22. A bullet extracting chuck 38 is slidably disposed in the bushing bore 36. The chuck 38 consists of a pair of concentrically disposed sleeves 40 and 42, slidable relative to each other, best illustrated in detail at FIG. 5. The inner sleeve 40 has a relatively thin wall 44 and is made of, preferably, hardened steel. The inner sleeve 40 is provided with two pairs of opposed slots 46 extending part of the length of the body of the sleeves and open to the end 48 thereof, thus forming four segments 47. The peripheral surface of the inner sleeve 40 is tapered, as shown at 50, proximate the end 48, and the inner surface of the sleeve segments 47 at their tip is substantially cylindrical and highly polished so as to define four jaw faces 49.

The outer sleeve 42 has a substantially cylindrical inner bore 52 slidably accepting the inner sleeve 40, and the end of the outer sleeve 42 has a tapered bore surface 54 complementary of the taper 50 on the peripheral surface of the inner sleeve 40. In this manner, when the inner sleeve 40 is retracted within the outer sleeve 42, with the tapered surfaces 50 and 54 out of engagement, as shown at FIG. 1, the jaw faces 49 are free, and when the inner sleeve 40 is longitudinally displaced relative to the outer sleeve 42 such as to force the tapered surfaces 50 and 54 in engagement, the end of the inner sleeve 40 tends to be contracted and the jaw faces 49 are capable of strongly gripping the outer surface of the bullet 30.

The outer sleeve 42 of the chuck 38 is reciprocable towards, and away from, the cartridge hold-down fixture 22 by means of a pair of spaced apart levers 56. Each of the levers 56 is pivotally mounted relative to the frame 10 by way of an arm 58, welded or bolted on the end thereof, and or a link 60, pivot points being provided by pins or bolts, as shown at 62 and 64, between the end of the arm 58 and one end of the link 60, and between the other end of the link 60 and the frame 10, respectively.

Each of the levers 56 is disposed on one side of the end of the outer sleeve 42 projecting from the bushing bore 36 on the top of the upper portion 14 of the frame 10. The upper end of the outer sleeve 42 has a shoulder 66 provided with a pair of diametrally disposed pins 68 projecting through a transverse bore 70 formed in each lever 56. In this manner, swinging motion of the levers 56 in unison causes reciprocation of the outer sleeve 42.

The upper end of the inner sleeve 40 projects from the upper end of the outer sleeve 42 and is provided with a shoulder 70 which, by engagement with the shoulder 66 of the outer sleeve 42, prevents the inner sleeve 40 from being reciprocated relative to the outer sleeve 42 beyond a predetermined limit, such as to prevent permanent deformation or breakage of the segments 47 at the end of the inner sleeve 40 in the event that the inner sleeve 40 is downwardly displaced relative to the outer sleeve 42 with no bullet engaged between the jaw surfaces 49. The shoulder 70 is provided with a pair of diametrally opposed radial pins 72 engaged in an appropriate bore in each arm member 74 defining the bifurcated end of a lever 76 provided with a handle 78. A pair of aligned fulcrum pins, or bolts, 80 laterally project each from one of the lever arms 74, each pin 80 being engaged in a horizontally disposed slot 82 formed in each lever 56, such as to provide a floating fulcrum point for the lever 76, as best shown at FIGS. 1 and 2.

The inner sleeve 40 of the bullet chuck 38 has an inner bore of a diameter slightly larger than the normal diameter between the jaw surfaces 49 which, in turn, is slightly less than the bullet nominal diameter. The upper end of the inner sleeve 40 opens into a flexible tubing 84, the end of which is disposed above a receptacle 86 disposed at a convenient location.

In order to operate the apparatus of the invention for separating bullets from their cartridge cases, each cartridge is slipped in turn into the hold-down fixture 22 such that the arcuate flange 24 of the hold-down fixture engages the extracton groove of the cartridge case head, the chuck 38 being held lifted by means of the handle 78 such as to clear the bullet 30. The chuck 38 is subsequently advanced towards and over the bullet 30, by action on the handle 78, the amount of downward motion of the chuck being determined by the adjustment of a set screw 88, threaded through an appropriate threaded bore 90 formed in a link 60, whose end abuts against the end of one of the levers 56. In such a position, as illustrated in FIG. 1, the inner sleeve 40 of the chuck 38 is presented over the end of the bullet 30, with the periphery of the bullet partially engaged between the jaw surfaces 49, the tapered surface 50 of the inner sleeve 40 being not yet engaged with the tapered inner surface 54 of the outer sleeve 42.

An upward pull on the end of the handle 78 causes the lever 76 to swing about its floating pivot pooint 80 relative to the parallel levers 56, thus displacing the inner sleeve 40 downwardly relative to the outer sleeve 42, causing the tapered outer surface 50 of the inner sleeve to engage the tapered inner surface 54 of the outer sleeve, which in turn causes the jaw surfaces 49 defined at the end of the inner sleeve to tend to contract, thus solidly gripping the surface of the bullet 30, as shown at FIG. 3. Further upward force applied to the end of the handle 78 causes the parallel levers 56 to be lifted, therefore pulling the bullet 30 from its cartridge case 28, as shown at FIG. 4. It can be seen that the more solidly the bullet 30 is held in the mouth of the cartridge case 28, the greater the upward force which must be applied to the handle 78 to separate the bullet from the cartridge case, causing in turn a proportional increase of the force with which the tapered surfaces 50 and 54 are engaged with each other, thereby causing a proportional increase of the gripping power of the jaw surfaces 49. It can also be seen that levers 56 and 76 may be manually independently actuated such that the gripping power of the jaw surfaces can be further increased if necessary. However, it will be appreciated that, in normal operation, it is sufficient to simply actuate the reciprocation of the bullet chuck 38 by means of operating the handle 78.

The distance diametrally separating the jaw surfaces 49 is normally slightly less than the nominal diameter of a bullet of a predetermined caliber, such that after extraction from its cartridge case, each bullet remains frictionally engaged between the jaw surfaces of the inner sleeve 40 by causing the segments 47 to resiliently flex slightly outwardly. The cartridge case 28 is removed from the hold-down fixture 22, and another cartridge is placed therein. By action of the handle 78, the cartridge chunk 38 is brought down from the position shown at FIG. 4 to the position shown at FIG. 1, thus causing the bullet 30 of the cartridge to project between the jaw surfaces 49 of the inner sleeve 40 and to push upwardly the bullet frictionally held between the jaw surfaces. The bullet is pulled from the cartridge case in the same manner as previously explained, and it can be seen that as bullets are successively removed from their cartridge cases, they are fed through the hollow body of the inner sleeve 40 to the tubing 84, and from here to the container 86.

It will be appreciated that the jaw surfaces 49 are capable of exerting a very strong gripping power on a bullet. Because of such strong gripping power of the jaws, the apparatus of the invention is capable of pulling flat point bullets, as shown at 30′ at FIG. 5, which have a very short body length projecting from the mouth of the cartridge case. Furthermore, because of the relatively large surface area of the jaw surfaces engaged with the peripheral surface of the bullet, the surface of conventional bullets are not marred, scratched or marked in any manner by the apparatus of the present invention, even when the bullets are tightly set in the cartridge case mouth.

It will be appreciated that ammunition of diverse lengths may be accomodated by the apparatus of the present invention by way of adjustment of the adjustable abutment means provided by the set screw 88. It will also be appreciated that ammunition of diverse calibers may be accomodated by providing a set of inner sleeves 40 having jaws of appropriate diameters or, alternatively, by providing appropriate sets of bullet chucks 38 and appropriate sets of hold-down fixtures 22 to accomodate diverse sizes and shapes of ammunition.

It will also be appreciated that the apparatus of the invention may be easily motorized by providing automatic means for feeding consecutive cartridges to the hold-down fixture 22, or by replacing the hold-down fixture by a rotary table holding down a plurality of cartridges, the feeding of the cartridges, or the rotation of the table, being synchronized with the operation of the lever 78. The lever 78 may be actuated by any convenient means such as a power driven cam engaged with an appropriate cam follower mounted on the end of the handle 78.

Having thus described the invention by way of a typical structural example thereof, modifications whereof will be apparent to those skilled in the art, what is claimed as new is as follows:

1. An apparatus for separating a bullet from a cartridge case, said apparatus comprising a frame, hold-down means mounted on said frame, a reciprocating chuck comprising an inner and an outer sleeve concentrically and slidably disposed one within the other, said inner sleeve having an end forming engageable inner jaw surfaces over said bullet defined by at least a pair of end segments formed by diametrally opposed longitudinal slots extending all the way to the end of said inner sleeve, a tapered peripheral surface formed on said inner sleeve proximate said end and a tapered portion on the inner surface of said outer sleeve for engagement with said tapered peripheral surface for applying said gripping force to said jaw surfaces by urging said opposed segments toward each other, and lever means reciprocating said chuck, said lever means comprising a first lever having a floating fulcrum pivot on said frame and being pivotally attached to said outer sleeve for reciprocating said outer sleeve, a second lever pivotally attached to said inner sleeve and having a floating fulcrum on said first lever for reciprocating said outer sleeves relative to said first sleeve for applying said gripping force to said jaw surfaces and for subsequently reciprocating said inner and outer sleeves in unison away from said cartridge hold-down means.

2. The apparatus of claim 1 wherein said jaw surfaces frictionally engage said bullet for holding said bullet within said inner sleeve when said outer sleeve is reciprocated toward said cartridge hold-down means for causing said bullet to be translated longitudinally in said sleeve by a subsequent bullet engaged in said end, and conduit means connected to the other end of said inner sleeve for discharging said bullets to a container.

3. The apparatus of claim 1 further comprising abutment means limiting the amount of reciprocation of said chuck toward said cartridge hold-down means.

4. The apparatus of claim 3 wherein said abutment means is adjustable.

5. In an apparatus for pulling a bullet from a cartridge case, said apparatus comprising means for holding said cartridge case, means for gripping said bullet, and power amplifying means for moving said bullet gripping means away from said cartridge case holding means, the improvement for said bullet gripping means comprising a pair of concentric independently reciprocable sleeves, the inner one of said sleeves having a peripherally tapered end and the outer one of said sleeves having a correspondingly internally tapered end, said inner sleeve having at least a pair of diametrally opposed segments formed by longitudinal slots extending from the tapered end of said inner sleeve, opposed jaw surfaces formed at the end of said segments, and wherein said power amplifying means are adapted to reciprocate said inner sleeve relative to said outer sleeve for mutually engaging said tapered surfaces for urging said segments toward each other and clamping said jaw surfaces over said bullet and to subsequently reciprocate said inner and outer sleeves in unison for pulling said bullet from said cartridge case, said power amplyfying means comprising a first lever pivotally attached to said outer sleeve for reciprocating said outer sleeve, a second lever pivotally attached to said inner sleeve for reciprocating said inner sleeve, said second lever having a floating fulcrum on said first lever and adapted to first differentially operating said first lever for relatively reciprocating said inner and outer sleeves for applying said gripping force to said jaw surfaces and to subsequently simultaneously operate said first lever for reciprocating said inner and outer sleeves in unison away from said cartridge case holding means.

6. The apparatus of claim 5 wherein said jaw surfaces frictionally engage said bullet for holding said bullet within said inner sleeve when said outer sleeve is reciprocated toward said cartridge case holding means for causing said bullet to be translated longitudinally in said sleeve by a subsequent bullet engaged in said end, and conduit means connected to the other end of said inner sleeve for discharging said bullets to a container.

7. The apparatus of claim 5 further comprising abutment means limiting the amount of reciprocation of said inner and outer sleeves toward said cartridge case holding means.

8. The apparatus of claim 7 wherein said abutment means is adjustable.

* * * * *

UNITED STATES PATENT OFFICE

CERTIFICATE OF CORRECTION

PATENT NO. : 4,005,630

DATED : February 1, 1977

INVENTOR(S) : Dale M. Patrick

It is certified that error appears in the above-identified patent and that said Letters Patent are hereby corrected as shown below:

Column 5, Claim 1, line 17, after "frame," insert --cartridge--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*